United States Patent [19]

Jacobs, Jr.

[11] 4,054,858

[45] Oct. 18, 1977

[54] ELECTRIC FUSE CAPABLE OF INTERRUPTING SMALL OVERLOAD CURRENTS BY SERIES MULTIBREAKS

[75] Inventor: Philip C. Jacobs, Jr., Newtonville, Mass.

[73] Assignee: Gould, Inc., Newburyport, Mass.

[21] Appl. No.: 733,918

[22] Filed: Oct. 19, 1976

[51] Int. Cl.[2] ..... H01H 85/12

[52] U.S. Cl. ..... 337/162; 337/293; 337/296

[58] Field of Search ..... 337/162, 161, 160, 159, 337/158, 290, 291, 292, 293, 295, 296, 221

[56] References Cited

U.S. PATENT DOCUMENTS

| | | | |
|---|---|---|---|
| 3,341,674 | 9/1967 | Jacobs, Jr. | 337/221 |
| 3,705,373 | 12/1972 | Cameron | 337/160 |
| 3,810,062 | 5/1974 | Kozacka | 337/161 |
| 3,864,655 | 2/1975 | Kozacka | 337/160 |
| 3,969,694 | 7/1976 | Kozacka | 337/161 |

*Primary Examiner*—Harold Broome

*Attorney, Agent, or Firm*—Erwin Salzer

[57] ABSTRACT

The fusible element of a fuse that needs series multibreaks for interrupting small currents is provided with a shunt current path including an arc gap in the center region thereof. That current path does not normally carry any current on account of the presence of the arc gap in it. The shunt current path shunts a portion of the fusible element including a so-called M-effect causing overlay. When that overlay becomes operative it causes formation of an arc gap in the fusible element which, in turn, causes a voltage to appear across the arc gap. When that voltage is sufficiently high the arc gap breaks down. The ensuing arc current is too small to allow formation of series breaks in the fusible element. The fusible element or the above shunt thereof are provided with beads that evolve gases under the action of the arc. These gases are directed to the points of junction of the fusible element and its shunt and due to this artificial gap contamination by hot gases the arc current becomes sufficiently high to produce series breaks in the fusible element.

9 Claims, 5 Drawing Figures

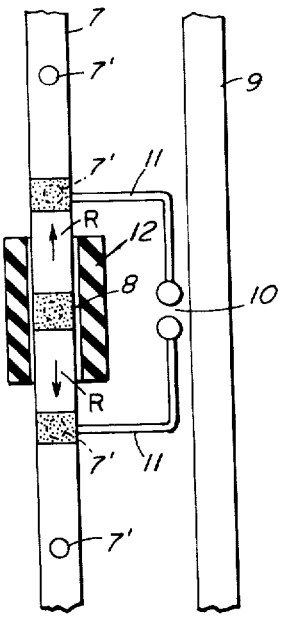
FIG. 1
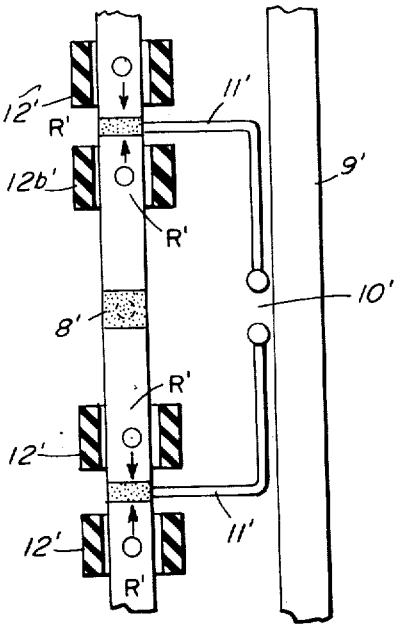
FIG. 2
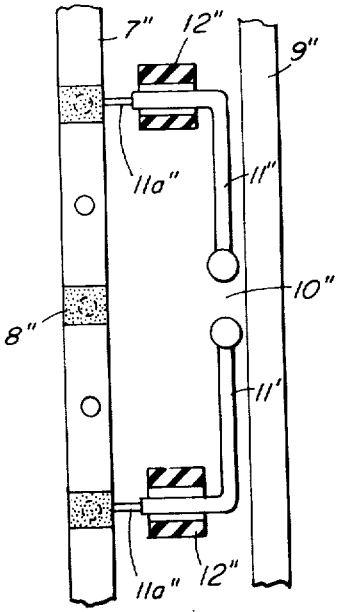
FIG. 3
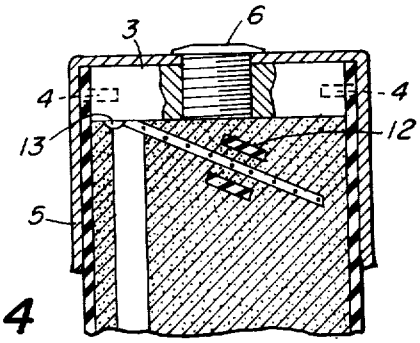
FIG. 4
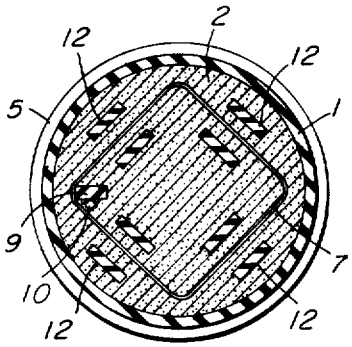
FIG. 5
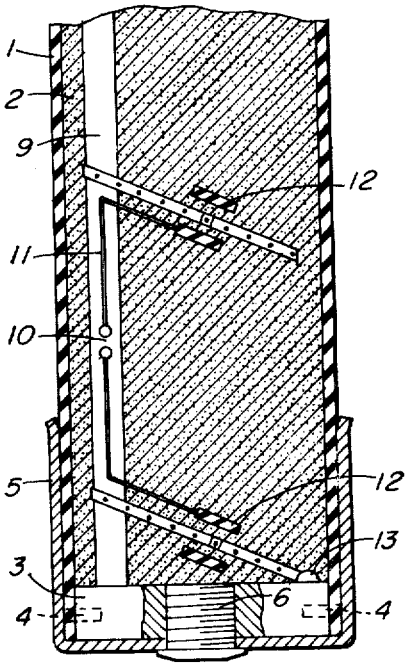

ELECTRIC FUSE CAPABLE OF INTERRUPTING SMALL OVERLOAD CURRENTS BY SERIES MULTIBREAKS

BACKGROUND OF THE INVENTION

This invention is an outgrowth of the subject-matter of U.S. Pat. No. 3,735,317; May 22, 1973 to Philip C. Jacobs, Jr. for ELECTRIC MULTIBREAK FORMING CARTRIDGE FUSE, of the subject-matter of U.S. Pat. No. 3,810,062 to Frederick J. Kozacka; May 7, 1974 for HIGH-VOLTAGE FUSE HAVING FULL RANGE CLEARING ABILITY; and of the subject-matter of U.S. Pat. No. 3,848,214 to Erwin Salzer; Nov. 12, 1974 for METHOD OF ASSEMBLING ELECTRIC HIGH-VOLTAGE FUSES AND SUBASSEMBLY THEREFOR.

The above patent to Jacobs solves the problem of forming series breaks in a fusible element incident to occurrence of small protracted overloads. The fusible element or fuse link is provided with a link-severing low fusing point overlay which forms a break at very small overloads, e.g. the 1 hour fusing current. The fuse of Jacobs includes a shunt across the overlay portion of the fuse link which shunt is adapted to generate relatively large amounts of heat at the ends thereof conductively connected to the fusible element at opposite sides of said overlay thereof. Normally the shunt does not carry any significant current on account of its high resistance. The shunt begins to carry a significant current following formation of a break by a metallurgical reaction between the base metal of the fusible element and ther overlay metal at the point of said overlay. Thereafter the ends of the shunt that generate relatively large amounts of heat fuse and kindle arcs between the fusible element and its shunt. These arcs are supposed to form two additional breaks in the fusible element, one to each side of the overlay thereof. Because these arcs are relatively low current arcs, the time involved in forming the two aforementioned additional breaks in the fusible element is relatively long.

It is, therefore, one object of this invention to provide means that contaminate the arc gaps formed between the fusible element and its shunt by evolution of jets of hot gases, thus greatly accelerating the formation of breaks in the fusible element to both sides of said overlay thereof.

The above Kozacka patent describes a fuse, more particularly a fuse for elevated voltages having oblong beads of a material consisting, e.g., of melamine and inorganic fillers. These beads are mounted on the fusible element and produce oppositely directed jets of hot gases which work like a dual direction gas blast breaker in deionizing the arc gap formed inside the beads. The aforementioned jets of hot gases are not only excellent deionizers, but are also excellent ionizers, and are applied as such according to the present invention.

The aforementioned patent to Salzer discolses a fixture for making fuses for elevated circuit voltages. The cylindrical plug terminals of the fuse form a part of the fixture and are tied together by a plurality of metal rods extending parallel to the common axis of the plug terminals. Thus the plug terminals and said plurality of metal rods form jointly a squirrel-cage-like structure. A fusible element is wound helically around the metal rods and its ends are conductively connected to the axially inner end surfaces of the plug terminals. Thereafter the entire assembly is inserted in coaxial relation into a tubular casing of electric insulating material and the ends of the latter are pinned to the plug terminals. Then the casing is filled with a pulverulent arc-quenching filler, preferably quartz sand. After the pulverulent arc-quenching filler has been duly compacted it is capable of supporting the helically wound fusible element or elements. Thus the fusible element supporting rods are not needed any longer and may be withdrawn in a direction longitudinally thereof from the fusible element and removed from the casing by appropriate bores in one of the plug terminals. The resulting high-voltage fuses contain a relatively higher volume of pulverulent arc-quenching filler than conventional high-voltage fuses, i.e. the filler volume is increased by a volume equal to that normally occupied by mandrel-like solid supports for the fusible element. Elimination of such supports is further desirable because of their relatively high cost, the danger of becoming more or less conductive under the heat of high-current arcs, the danger of evolving too much gas under the action of such arcs, etc. Fuses as shown in the above patent to Salzer do not lend themselves to interruption of protracted very small overload current, e.g. the three hour fusing current.

It is, therefore, another object of this invention to modify the fuses disclosed in the above patent to Salzer in such a way as to impart them with the ability of effectively interrupting small protracted overload currents.

A still narrower object of this invention is to modify the fuses disclosed in the above patent to Salzer by incorporation into the same of a greatly improved version of the deionizing means disclosed and claimed in U.S. Pat. No. 3,969,694; July 13, 1974 to Frederick J. Kozacka for ELECTRIC FUSE FOR ELEVATED CIRCUIT VOLTAGES CAPABLE OF INTERRUPTING SMALL OVERLOAD CURRENTS.

SUMMARY OF THE INVENTION

Electric fuses embodying this invention include a first low resistance fusible element conductively interconnecting a pair of terminal elements and forming a plurality of serially related points of reduced cross-sectional area. Said first fusible elementhas means at a predetermined point thereof causing formation of a break therein at the occurrence of small protracted overload currents. The fuse according to this invention further includes a shunt across said point of break formation having an arc-gap in the center region thereof and having ends conductively connected to said fusible element. Finally fuses embodying this invention have beads mounted on the fusible element or its shunt of a material evolving a gas when heated and generating jets of hot gasbeing directed at the points of connection of said fusible element and said shunt to help in the ionization of these points. Both said fusible element and said shunt are enclosed in a casing of electric insulating material which is filled with a pulverulent arc-quenching filler.

BRIEF DECRIPTION OF THE DRAWINGS

FIG. 1 is a diagrammatic representation of some of the essential parts of a fuse embodying this invention;

FIG. 2 is another embodiment of the idea underlying FIG. 1;

FIG. 3 is still another embodiment of the idea underlying FIG. 1;

FIG. 4 is a diagrammatic longitudinal section of an entire fuse embodying the present invention; and FIG, 5 is a cross-section of the structure of FIG. 4.

DESCRIPTION OF PREFERRED EMBODIMENT

Referring to the drawings, numeral 1 has been applied to indicate a tubular casing of electrical insulating material, e.g. a melamine-glass-cloth laminate. Casing 1 is filled with a pulverulent arc-quenching filler 2, e.g. quartz sand. The ends of casing 1 are closed by a pair of metallic terminal elements 3 in the form of cylindrical plugs 3. The plug terminals 3 are affixed to the ends of casing 1 by steel pins 4 projecting radially into plug terminals 3. The ferrules 5 are mounted on the outer ends of casing 1 and affixed to plug terminals 3 by means of hex screws 6. Plug terminals 3 are conductively interconnected by a first fusible element 7 embedded in pulverulent arc-quenching filler 2. Fusible element 7 has a relatively small resistance and is preferably formed by a ribbon of sheet silver provided with serially arranged perforations 7'. It is preferably in the shape of a helical winding as indicated in FIGS. 4 and 5. Element 7 might also be straight rather than helical. However, the straight fusible element 7 shown in FIG. 1 is but a diagrammatic representation of the helical shape indicated in FIGS. 4 and 5. Perforations 7' form a plurality of serially related points of reduced cross-sectional area where arc initiation occurs incident to major short-circuit-current-like fault currents. Fusible element 7 is provided at a predetermined point thereof with means 8 for causing formation of a break therein at the occurrence of small protracted overloads. Means 8 is preferably an overlay of a low fusing points metal, e.g. tin, that evers fusible element 7 upon fusion thereof by a metal diffusion process at the point where overlay 8 is located. Reference character 9 has been applied to indicate a rod of electric insulating material that extends parallel to the axis of casing 1, but is spaced from said axis. The ends of rod 9 are affixed to terminal elements 3, e.g. inserted into recesses thereof (not shown in the drawings). As shown in FIG. 5 the cross-section of rod 9 is preferably rectangular, and rod 9 supports on its surface the arc gap 10. Arc gap 10 is conductively connected by wire 11 to said fusible element 7. As shown in FIG. 1 fusible element 7 supports a bead 12 of gas-evolving material which produces jets of plasma indicated by the arrows R. Wire 11 is connected to fusible element 7 at preforations 7' which are exposed directly to the jets of hot gases or plasma R. The points of junction of 7 and 11 each have an overlay of tin or the like M-effect producing metal to reduce the temperature at which these points will be severed.

Normally the above shunt current path 10, 11 does not carry any current. Small protracted overloads result in fusion of overlay 8 and, therefore, fusible element 7 is severed by a metallurgical reaction at the point of overlay 8. This causes appearance of a voltage across arc gap 10 sufficiently high to cause breakdown of that gap. The current through that gap combined with the blast of arc products out of the ends of elongated bead 12 result in kindling and maintenance of an electric arc which quickly severs fusible element 7 at the two points where it is connected to shunt 11.

The structure of FIG. 2 differs from that shown in FIG. 1 in that pairs of gas-evolving bead 12' are substituted for beads 12 and produce oppositely directed gas blasts R'. In FIG. 2 the parts corresponding to those of FIG. 1 have been designated by the same reference numeral with a prime sign added which makes FIG. 2 self-explanatory.

As shown in FIG. 3, the fusible element 7'' is shunted by shunt 11'' including arc gap 10''. Shunt 11'' comprises the high resistance portions **11*a*'' and the low resistance portions. The former are conductively connected to fusible element 7'' at points which are perforated and have an overlay of an M-effect-causing metal. The beads 12'' of gas-evolving material are mounted on the low-resistance portion of the shunt 11''**.

Initially overlay 8''fuses and causes formation of a small break. The arc voltage across said break causes breakdown of arc gap 10''. This establishes a shunt path across overlay 8'' which shunt path fuses at **11*a*''. The burnback of the small current arc thus initially formed into beads 12''' generates arc products which contaminate the arc gap and result in formation of two series breaks at the points 11*a*'' where the shunt current path 11'' is connected to fusible element 7''**.

The rods 9,9', 9'' shown in FIGS. 1–3 which support the arc gap 10,10', 10'' assure sufficient constancy of gap length and of break down voltage.

It will be apparent from FIG. 3 that the same numerals with two prime signs added have been used to designate like parts as in FIGS. 1 and 2.

When manufacturing the fuse structure shown in FIGS. 4 and 5 the fusible element 7 is wound helically around four rods forming jointly with plug terminals 3 a squirrel-cage-like structure. These four rods define a prism which is substantially square in cross-section. Three of the aforementioned rod around which fusible element 7 is wound are of a stiff metal and are withdrawn from the fusible element 7 and from casing 1 as disclosed in detail in the aforementioned U.S. Pat. No. 3,848,214 to Salzer. The fourth rod around which fusible element 7 is wound is insulating rod 9. Rod 9 is not withdrawn from fusible element 7 and not removed from casing 1. In the structure shown in FIGS. 4 and 5 full turns of fusible element 7 engage rod member 9 at a single point. Hence full turns of fusible element 7 are only supported by the pulverulent arc-quenching filler 2, except at one single point of the particular turn where the latter is supported by tie rod 9 by which both terminal elements 3 are tied together. As clearly shown in FIG. 4 the ends of fusible element 7 are screwed by means of screws 13 against the axially inner end surfaces of terminal plugs 3 and thus also supported at these two specific points. The fact that turns of helical winding 7 situated between crews 13 are supported at one point by insulating rod 9 tends to increase the dimensional stability of helical winding 7. The tie rod 9 between plug terminals 3 has the additional function of supporting the spark gap 10,10' and 10'', respectively.

As shown in FIGS. 4 and 5 the first fusible element 7 is wound in quarter turn sections around a space in the form of a four-sided prism and full turns of fusible element 7 are supported at but one single point thereof by the terminal-interconnecting tie rod 9.

It should finally be observed that FIG. 1 and FIG. 5 differ inasmuch as a single bead is used in FIG. 1 to produce the blast action in opposite directions, while in FIG. 5 the blast action is produced by two beads or bead means separated by a plurality of points 7' of reduced cross-sectional area.

I claim as my invention:

1. An electric fuse adapted to form multibreaks at the occurrence of small protracted overload currents including a. a tubular casing of electric isulating material;

b. a pulverulent arc-quenching filler inside said casing;

c. a pair of metallic terminal elements closing the ends of said casing;

d. conductive means interconnecting said pair of terminal elements, said conductive means including a fusible element and a shunt shunting a portion of said fusible element;

e. said fusible element having a relatively small resistance and forming a plurality of serially related points of reduced cross-section area and said fusible element further having means situated between two of said points of reduced cross-sectional area for causing formation of a break therein at the occurrence of small protracted overloads;

f. said shunt shunting said point of break formation, having an arc gap in the center region thereof and having ends conductively connected to said fusible element; and g. bead means mounted on said conductive means of a material evolving a gas when heated and generating jets of hot gas directed at the points of connection of said fusible element and said shunt to help in the ionization of these points.

2. A fuse as specified in claim 1 wherein said bead means are mounted at a point of said conductive means where and arc is initially kindled, and wherein jets of plasma are directed from said bead means to the point of junction of said fusible element and said shunt.

3. A fuse a specified in claim 1 wherein said bead means are mounted on said shunt immediately adjacent the points of junction of said fusible element and said shunt, and wherein the ohmic resistance of said shunt is highest immediately adjacent said points of junction.

4. A fuse as specified in claim 1 wherein points of junction of said fusible element and said shunt are provided with overlays of a metal having a low fusing points to sever said fusible elements at these points.

5. A fuse a specified in claim 1 wherein said bead means are mounted upon said fusible element at said points of reduced cross-sectional area thereof, and wherein a low melting point fusible element severing overlay is arranged outside of, but immediately adjacent to, said bead means.

6. An electric fuse as specified in claim 1 wherein said bead means are oblong, are mounted at said points of reduced cross-sectional area of said fusible elements, and wherein a low melting point fusible element severing metal is arranged inside each of said bead means.

7. An electric fuse as specified in claim 5 wherein said bead means are mounted in coaxial pairs on said fusible element so that the jets of hot gases evolving therefrom are of opposite direction and impinge upon each other.

8. An electric fuse as specified in claim 1 wherein a. said fusible element is formed by a substantially helical winding;

b. a rod member of electric insulating material is arranged parallel to, but in spaced relation from, the axis of said casing and having ends supported by said pair of terminal elements;

c. said rod member engaging and supporting full turns of said helical winding at one single point only, all other points of said full turns of said helical winding being unsupported by winding support means having axially outer ends in engagement with said pair of terminal elements; and d. said rod member also supporting said arc gap.

9. An electric fuse as specified in claim 1 wherein a. said first fusible element and said second fusible element are wound in quarter turn sections around a space in the form of a four-sided prism;

b. full turns of said first fusible element and full turns of said second fusible element are supported by a terminal-interconnecting tie rod of electric insulating material only at a single point thereof; and c. wherein said arc-gap is supported by said terminal-interconnecting tie rod.

* * * * *